US006447063B1

(12) United States Patent
Beggs

(10) Patent No.: US 6,447,063 B1
(45) Date of Patent: Sep. 10, 2002

(54) CHAIR SEAT TILT MECHANISM

(75) Inventor: Ken A. Beggs, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 09/612,641

(22) Filed: Jul. 7, 2000

(51) Int. Cl.[7] ..... A47C 1/032
(52) U.S. Cl. ..... 297/300.5
(58) Field of Search ..... 297/300.5, 300.4, 297/300.2, 300.8, 300.6, 374

(56) References Cited

U.S. PATENT DOCUMENTS

| | | | | | |
|---|---|---|---|---|---|
| 5,340,194 | A | * | 8/1994 | Neumuller | 297/374 |
| 5,423,594 | A | * | 6/1995 | Hancock et al. | 297/300.2 |
| 5,573,303 | A | | 11/1996 | Doerner | 297/300.5 |
| 5,664,834 | A | * | 9/1997 | Hsu | 297/300.5 |
| 5,685,607 | A | * | 11/1997 | Hirschmann | 297/300.8 |
| 6,120,096 | A | * | 9/2000 | Miotto | 297/300.5 |

* cited by examiner

*Primary Examiner*—Jerry Redman
(74) *Attorney, Agent, or Firm*—Shook, Hardy & Bacon L.L.P.

(57) ABSTRACT

A chair seat tilt mechanism includes a main frame for mounting to a spindle, a seat plate to which a chair seat may be mounted, a back bracket to which a chair back may be mounted, and first link arms. The first link arms are pivotally mounted at one end to the main frame by way of a main frame pivot and at another end to the rear of the seat plate by way of a rearward pivot. The back bracket is pivotally mounted near its front end to the main frame by way of a forward pivot and is further pivotally mounted to the seat plate at a medial pivot which is between the forward pivot and the rearward pivot. When assembled into a chair, if a chair occupant leans back against the chair back, the back bracket pivots about the forward pivot causing the medial pivot to move downwardly. This in turn causes the seat plate to pivot about the rearward pivot and results in a forward tilting of the chair seat. The first link arms may be capable of limited vertical translation such that when an overriding downward force is applied to the front of the chair seat, the seat plate pivots about the medial pivot to forwardly tilt the chair seat without backwardly tilting the chair back.

18 Claims, 3 Drawing Sheets

CHAIR SEAT TILT MECHANISM

FIELD OF THE INVENTION

The present invention relates to a chair seat tilting mechanism.

BACKGROUND OF THE INVENTION

Various types of office chairs are known that have a tiltable chair back and a chair seat tiltably mounted to a spindle. In one arrangement, when an occupant leans back in the chair, both the chair back and the chair seat tilt backwardly. This arrangement is disadvantageous in that the backward tilt of the chair seat may reduce blood circulation to the legs and prevent the occupant from assuming a completely comfortable position. An alternative arrangement alleviating these problems has been developed wherein the chair seat tilts forwardly when an occupant leans back in the chair. A mechanism consistent with this arrangement, described in U.S. Pat. No. 5,573,303 (the disclosure of which is hereby incorporated herein by reference), employs a link arm with a cam, a lever arm and a support that are mounted and arranged such that the desired forward tilting of the chair seat occurs when an occupant reclines the chair back.

A shortcoming of known chair seat tilting mechanisms is their inability to permit the front of the chair seat to tilt downwardly without the chair back tilting backwardly. A chair occupant may assume various positions, by extending one's legs forward with knees locked for example, in which increased downward pressure is applied to the front of the chair seat. This increased pressure may reduce circulation to the occupant's legs or otherwise result in discomfort on the part of the occupant. In such situations it would be desirable to have a mechanism in which the front of the chair seat tilts downwardly to relieve pressure on the occupant's legs even when the chair back is not tilted backwardly.

This invention seeks to provide an alternative to the forwardly tilting chair seat mechanism disclosed in U.S. Pat. No. 5,573,303 and which overcomes the drawback of known mechanisms.

SUMMARY OF THE INVENTION

It is an object of the present invention to provide a chair seat tilting mechanism wherein the chair seat tilts forwardly when an occupant leans back in the chair.

Advantageously, the mechanism may further allow the chair seat to tilt forwardly, without backwardly tilting the chair back, upon the application of an overriding downward force onto the front of the seat.

In accordance with an aspect of the present invention there is provided a chair seat tilting mechanism, comprising: a main frame for mounting to a seat spindle; a seat plate pivotable with respect to said main frame about a rearward pivot, said rearward pivot having limited lateral translational freedom with respect to said main frame; a back bracket pivotable with respect to said main frame about a forward pivot; and a medial pivot pivotably connecting said seat plate to said back bracket, said medial pivot medially positioned between said rearward pivot and said forward pivot such that pivoting said back bracket about said forward pivot in one direction draws said medial pivot downwardly so as to tilt said seat plate forwardly.

In accordance with another aspect of the present invention there is provided a chair seat tilting mechanism, comprising: a main frame for mounting to a seat spindle; a seat plate for mounting to a seat; a back bracket for mounting to a chair back; a rearward pivot pivotably connecting said seat plate to said main frame; means for permitting limited lateral translational freedom of said rearward pivot with respect to said main frame; a forward pivot pivotably connecting said back bracket to said main frame; and a medial pivot pivotably connecting said seat plate to said back bracket, said medial pivot medially positioned between said rearward pivot and said forward pivot such that pivoting said back bracket about said forward pivot in one direction draws said medial pivot downwardly so as to tilt said seat plate forwardly.

In accordance with still another aspect of the present invention there is provided a chair having a seat tilting mechanism, comprising: a chair spindle; a main frame mounted to said spindle; a seat plate pivotable with respect to said main frame about a rearward pivot, said rearward pivot having limited lateral translational freedom with respect to said main frame; a seat mounted to said seat plate; a back bracket pivotable with respect to said main frame about a forward pivot; a medial pivot pivotably connecting said seat plate to said back bracket, said medial pivot medially positioned between said rearward pivot and said forward pivot such that pivoting said back bracket about said forward pivot in one direction draws said medial pivot downwardly so as to tilt said seat plate forwardly; and a chair back mounted to said back bracket.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In the figures which illustrate an example embodiment of this invention.

DETAILED DESCRIPTION

Figure 1A:
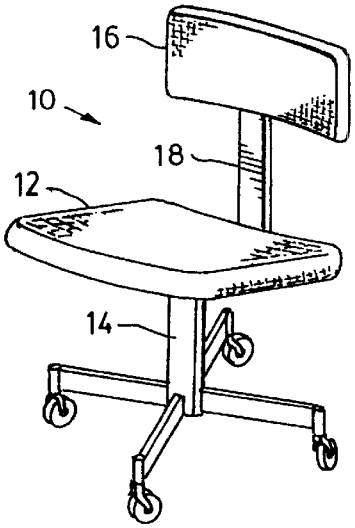
FIGS. 1A and 1B are perspective views of an office chair incorporating a chair seat tilting mechanism made in accordance with this invention.
Figure 1B:
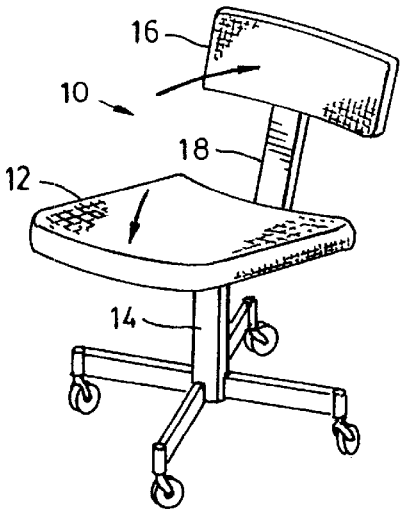

FIGS. 1A and 1B illustrate a chair 10 incorporating a chair seat tilting mechanism (not shown) exemplary of an embodiment of the present invention. Chair 10 comprises a chair seat 12 mounted above a spindle 14. A chair back 16,is mounted behind seat 12 by a chair back mounting arm 18. The chair 10 of FIG. 1A is shown in a resting position. As will become apparent, when chair back 16 is tilted backwardly from its resting position, chair seat 12 tilts forwardly as indicated in FIG. 1B.

Figure 2:
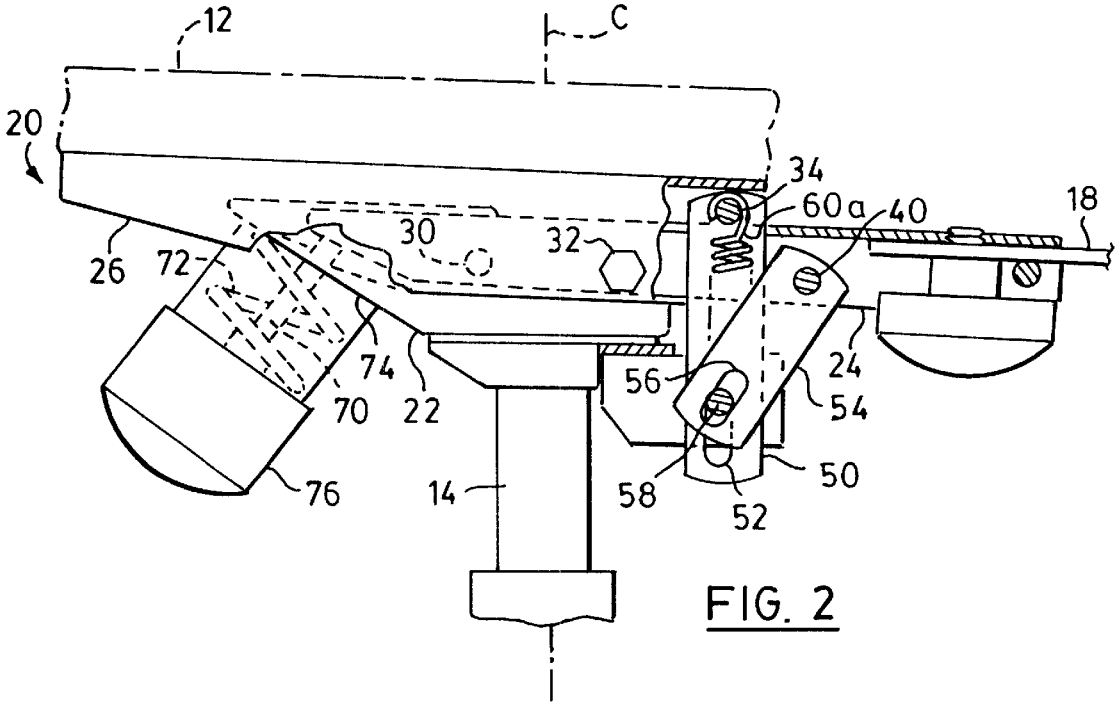
FIG. 2 is a side view of a portion of the chair of FIG. 1A in a resting position.
Figure 4:
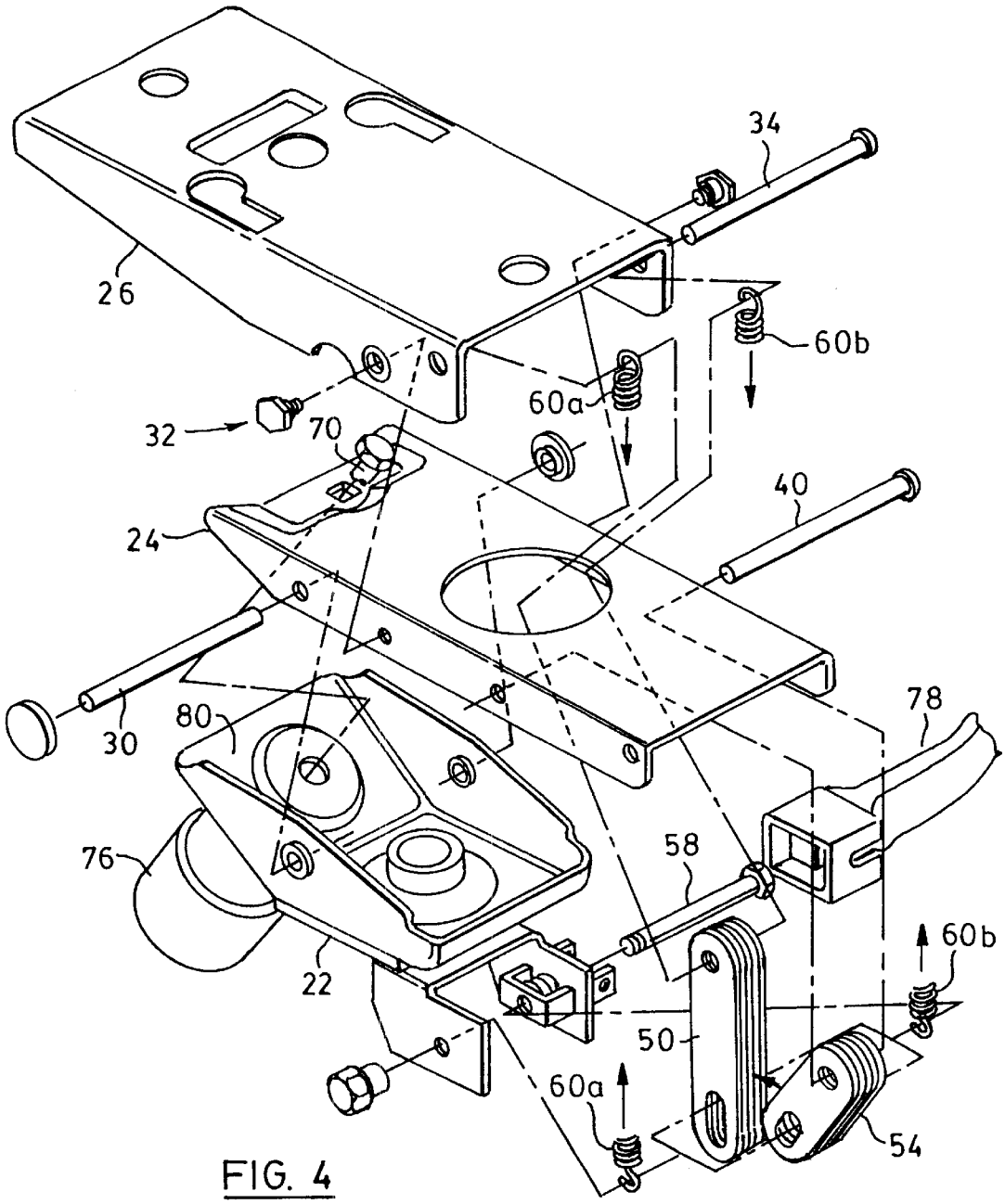
FIG. 4 is an exploded perspective view of a portion of the chair of FIG. 1A.

Turning to FIGS. 2 and 4, the chair seat tilting mechanism of this invention is indicated generally at 20. The mechanism 20 comprises a main frame 22 which may be mounted to the chair spindle 14 for rotation about the longitudinal axis C of the spindle 14. A back bracket 24 is pivotally mounted near its front end to the main frame 22 by way of forward pivot shaft 30. The other end of the back bracket 24 is mounted to the chair back mounting arm 18. A seat plate 26 for mounting to the chair seat 12 is pivotally mounted to the back bracket 24 at medial pivot 32. The rear of seat plate 26 is further pivotally mounted to one end of first link arms 50 at rearward pivot shaft 34. The first link arms 50 are pivotally mounted at their other end to the main frame 22 by way of main frame pivot pin 58. Because of the pivot mount between the first link arms 50 and the main frame 22, the pivot shaft 34 has a limited lateral translational freedom.

Second link arms 54 are pivotally mounted at one of their ends to the back bracket 24 by way of second link arm pivot 40. The other end of second link arms 54 are mounted to the main frame 22 at main frame pivot pin 58.

In the present embodiment, first link arms 50 and second link arms 54 act as clutch plates which, as will be described, permit the chair seat tilting mechanism 20 to be locked in a selected position. A lever arm 78 (FIG. 4) coupled to first link arms 50 and second link arms 54 may be manipulated by a chair occupant to enable such locking.

The main frame pivot pin 58 is received by elongate slots 52 in first link arms 50 and elongate slots 56 in second link arms 54. Slots 52 permit limited vertical translational movement of first link arms 50. Slots 56 impart some limited vertical translational freedom to second link arms 54. In an alternative embodiment, only one set of slots 52 and 56 receive pivot pin 58 and the other set of slots receive a separate pivot pin that is not co-located with pivot pin 58.

A primary biasing spring 72 (FIG. 2) acts between the back bracket 24 and the main frame 22 in order to bias the back bracket 24 to a rest position, which is the position shown in FIG. 2. The primary biasing spring 72 surrounds a shaft 70 and extends from the lower side 74 of main frame 22. The coil spring is compressed between lower side 74 of main frame 22 and a spring supporting knob 76 carried by shaft 70. Preferably shaft 70 is threaded into knob 76 so that the spring tension on the back bracket 24 may be adjusted by adjustment of knob 76.

Figure 3:
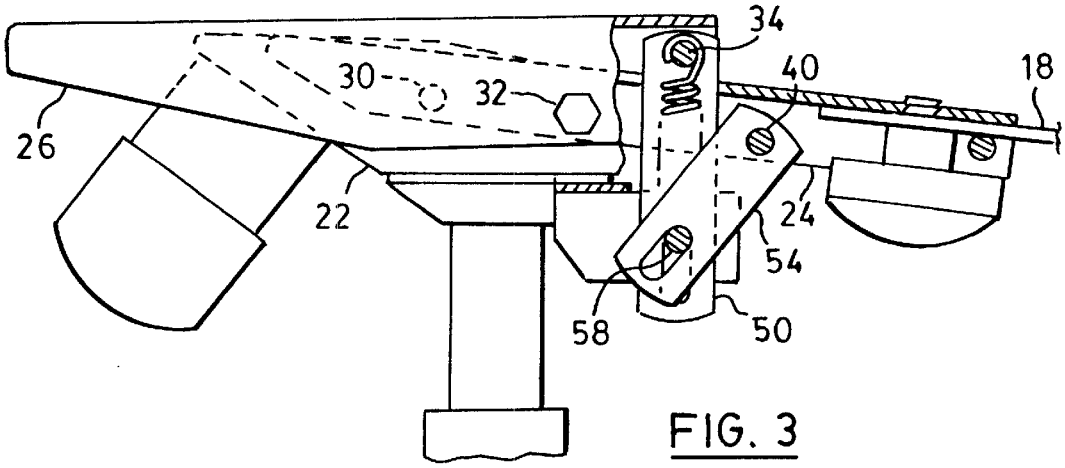
FIG. 3 is a side view of a portion of the chair of FIG. 1B in a reclined position.

Two springs 60*a* and 60*b* (FIG. 4) (cumulatively springs 60) act between the rearward pivot shaft 34 and the main frame pin 58 to urge pivot shaft 34 toward pin 58 thereby biasing the top of the elongate slots 52 of arms 50 against the pin 58 (as illustrated in FIGS. 2 and 3) in the absence of an overriding downward force on the front of the chair seat 12.

When an occupant of chair 10 leans back in the chair so as to tilt the seat back 16 backwardly as indicated in FIG. 1B, the resultant backward tilting of the seat back mounting arm 18 causes the back bracket 24 to rotate in a clockwise direction about forward pivot shaft 30 from its rest position shown in FIG. 2 to the reclined position shown in FIG. 3. This clockwise rotation of the back bracket 24 causes medial pivot 32 to move downwardly, thereby pulling the seat plate 26 downwardly at the medial pivot 32. The downward force at medial pivot 32 is transferred along seat plate 26 to the first link arms 50 at the rearward pivot 34. However, when the tops of the elongate slots 52 of first link arms 50 are maintained against the pin 58 by the springs 60, the first link arms 50 are incapable of downward translation and therefore downward movement of the rearward pivot 34 and the pivotally connected rear part of the seat plate 26 is prevented. Instead, the downward motion of the medial pivot 32 causes the free front end of seat plate 26 to rotate counter-clockwise about the rearward pivot 34, resulting in a downward tilting of the front of seat plate 26. With chair seat 12 attached to the seat plate 26, a corresponding forward tilt of the chair seat 12 results.

The clockwise rotation of the back bracket 24 about the forward pivot 30 causes the second link arm pivot 40 to move downwardly along an arc. This motion of the second link arm pivot 40 results in a translation of second link arms 54, which is accommodated by the slots 56 of link arms 54. Backward tilting of the chair back 16 beyond a particular inclination may be limited by contact of the upper ends of the slots 56 with the main frame pivot pin 58, which prevents of any further clockwise rotation of the back bracket 24 about the forward pivot 30.

It will be recognized that the degree to which the chair seat 12 is tilted forwardly with the backward tilting of the chair back 16 may be controlled by the positioning of the medial pivot 32 in relation to both the rearward pivot 34 and the forward pivot 30.

When a chair occupant leans against the chair back 16, the clockwise torque imparted to the back bracket 24 is resisted by a counter-clockwise torque applied by the spring 72. Thus, the occupant must overcome this resisting torque. Also, when a chair occupant ceases to lean against the chair back 16, the torque imparted by spring 72 acts as a restoring torque to rotate the back bracket 24 counter-clockwise about the forward pivot 30 from the position of FIG. 3 back to the position of FIG. 2.

Figure 5:
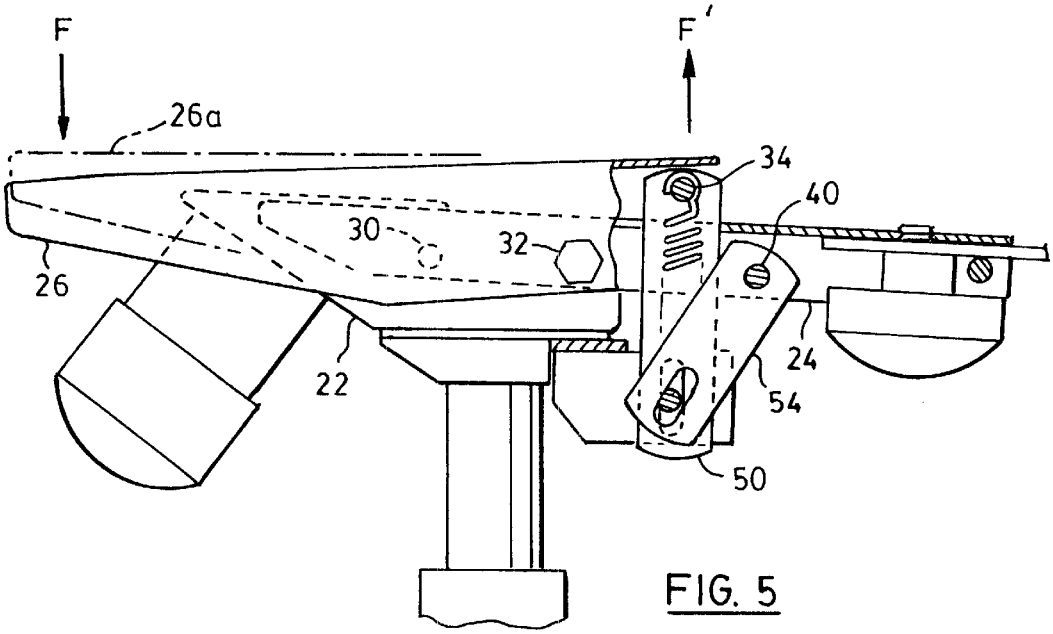
FIG. 5 is a side view of a portion of the chair of FIG. 1A wherein an overriding downward force has been applied to the front of the chair seat.

When a chair occupant assumes certain positions, such as when the occupant's legs are extended forwardly with knees locked for example, an overriding downward force F (FIG. 5) is applied to the front of the chair seat 12. This downward force F is transferred along the seat plate 26 to the back bracket 24 at the medial pivot 32. However, the clockwise torque about forward pivot 30 imparted onto the back bracket 24 by the downward force at the medial pivot 32 is insufficient to overcome the counter-clockwise restoring torque applied to the back bracket 24 by the spring 72, and clockwise rotation of the back bracket 24 about the forward pivot 30 is thus prevented. Accordingly, because the position of the back bracket 24 does not change, no backward tilting of the chair back 16 occurs. Moreover, the medial pivot 32 acts as a fulcrum about which the seat plate 26 rotates in a counter-clockwise direction. The downward force F applied at the front of the seat plate 26 thus causes a corresponding upward force F' (FIG. 5) to be applied to the link arm pivot 34 at the rear of the seat plate 26. The upward force on the connected first link arms 50 causes an upward translation of the arms 50 which is accommodated by slots 52. This translation permits the front of seat plate 26 (and the attached chair seat 12) to tilt forwardly from its resting position 26*a* to the position illustrated in FIG. 5. The pressure upon the occupant's legs is therefore reduced, while the position of chair back 16 remains unchanged.

The counter-clockwise torque imparted to the seat plate 26 due to the application of downward force F is resisted by a clockwise torque applied by the secondary biasing springs 60*a* and 60*b* (FIG. 4). Thus, downward force F must be sufficient to overcome this resisting torque in order for independent forward tilting of the chair seat 12 as described above to occur. Furthermore, when application of the downward force F ceases, the torque imparted by springs 60*a* and 60*b* acts as a restoring torque to rotate the seat plate 26 clockwise about the medial pivot 32 from its position in FIG. 5 back to the position of FIG. 2.

It will be recognized that the forward tilting of chair seat 12 upon the application of an overriding downward force F is independent from the forward tilting of the seat resulting from an occupant leaning back in the chair. Thus, regardless of whether chair seat 12 is tilted forwardly due to an occupant leaning back in the chair, the additional application of a downward force F to the front of the chair seat 12 may cause further downward tilting of the seat.

The exemplary chair mechanism 20 may be locked in a selected position by engaging the clutch plates comprising the first link arms 50 and second link arms 54. Engagement of the clutch plates is typically achieved through manipulation of the lever arm 78 (FIG. 4) to laterally compress the clutch plates and thereby increase friction between the plates and the main frame 22, such that further movement of the mechanism is prevented until the clutch plates are disengaged.

It will be apparent to those skilled in the art that the second link arm pivot 40 may alternatively be located more proximately to the front end of back bracket 24 than the rearward pivot 34. As well, slots 56 could be in the top of second link arms 54 rather than, or in addition to, the bottom of arms 54. Similarly, slots 52 could be in the top of first link arms 50 rather than, or in addition to, the bottom. Alternatively, second link arms 54 may be omitted altogether. In that case the backrest could not be locked in position, but excessive backward tilting of the chair back 16 may be limited by the abutment of the front of the back bracket 24 against the underside of the seat plate 26.

In yet another alternative, a single first link arm 50 may be used in place of multiple first link arms 50. Similarly, a single second link arm 54 may be substituted for multiple second link arms 54. It will be recognized that such substitution may impact upon the effectiveness of the locking mechanism controlled by lever arm 78.

Other modifications will be apparent to those skilled in the art and, therefore, the invention is defined in the claims.

What is claimed is:

1. chair seat tilting mechanism, comprising:

a main frame for mounting to a seat spindle;

a seat plate pivotable with respect to said main frame about a rearward pivot, said rearward pivot having limited lateral translational freedom with respect to said main frame;

a back bracket pivotable with respect to said main frame about a forward pivot; and a medial pivot pivotably connecting said seat plate to said back bracket, said medial pivot medially positioned between said rearward pivot and said forward pivot such that pivoting said back bracket about said forward pivot in one direction draws said medial pivot downwardly so as to tilt said seat plate forwardly.

2. The mechanism of claim 1 further comprising:

a link arm extending between said seat plate and said main frame, said link arm carrying said rearward pivot, said link arm pivotably connected to said main frame to provide said limited lateral translational freedom of said rearward pivot.

3. The mechanism of claim 2 wherein said link arm is a first link arm and further comprising a second link arm extending between said main frame and said back bracket.

4. The mechanism of claim 3 wherein said first link arm is one of a plurality of first link arms and said second link arm is one of a plurality of second link arms interleaved with said first link arms and further comprising a compressor for compressing said first link arms against said second link arms to thereby frictionally engage said link arms.

5. The mechanism of claim 4 wherein said second link arms are pivotably connected to said backrest bracket and are pivotably connected to said main frame, one pivotable connection of each of said second link arms comprising slots in said second link arms.

6. The mechanism of claim 5 wherein said first link arms carrying said rearward pivot provides one pivotable connection of said first link arms and wherein said link arm pivotably connected to said main frame provides another pivotable connection of said first link arms, said one or said another pivotable connection of each of said first link arms comprising slots in said first link arms.

7. The mechanism of claim 6 wherein said pivotable connection of said first link arms to said main frame and said pivotable connection of said second link arms to said main frame is made by a common main frame pivot.

8. The mechanism of claim 2 wherein said link arm carrying said rearward pivot provides one pivotable connection of said link arm and wherein said pivotable connection of said link arm to said main frame provides another pivotable connection of said link arm and wherein said one or said another pivotable connection of said link arm comprises slots in said link arm receiving a pivot pin such that said seat plate may be tilted forwardly independently of any pivoting of said back bracket.

9. The mechanism of claim 8 further comprising a spring to bias said seat plate to a position whereat said pivot pin abuts an end of said slot whereat said seat plate is tilted less forwardly than when said pivot pin abuts an opposite end of said slot.

10. The mechanism of claim 2, further comprising primary biasing means acting between said main frame and said back bracket to bias said back bracket against rotation about said forward pivot in a direction which would cause said medial pivot to move downwardly.

11. The mechanism of claim 10, wherein said primary biasing means comprises a shaft supported by said front end of said back bracket and a coil spring extending from a face of said main frame opposite said front end of said bracket, said coil spring being compressed between said face of said main frame and a support on said shaft.

12. A chair seat tilting mechanism, comprising:

a main frame for mounting to a seat spindle;

a seat plate for mounting to a seat;

a back bracket for mounting to a chair back;

a rearward pivot pivotably connecting said seat plate to said main frame;

a forward pivot pivotably connecting said back bracket to said main frame; and medial pivot pivotably connecting said seat plate to said back bracket, said medial pivot medially positioned between said rearward pivot and said forward pivot such that pivoting said back bracket about said forward pivot in one direction draws said medial pivot downwardly so as to tilt said seat plate forwardly.

13. The mechanism of claim 19 further comprising:

first linking means extending between said seat plate and said main frame, said linking means carrying said rearward pivot, said linking means pivotably connected to said main frame to provide said limited translational freedom of said rearward pivot.

14. The mechanism of claim 13 further comprising second linking means extending between said main frame and said back bracket.

15. The mechanism of claim 14 further comprising compressing means for compressing said first linking means against said second linking means to thereby frictionally engage said linking means.

16. The mechanism of claim 13 further comprising means for permitting vertical translational freedom of said rearward pivot whereby said seat plate may be tilted forwardly independently of any pivoting of said back bracket.

17. The mechanism of claim 12, further comprising primary biasing means acting between said main frame and said back bracket to bias said back bracket against rotation about said forward pivot in a direction which would cause said medial pivot to move downwardly.

18. A chair having a seat tilting mechanism, comprising:

a chair spindle;

a main frame mounted to said spindle;

a seat plate pivotable with respect to said main frame about a rearward pivot, said rearward pivot having limited lateral translational freedom with respect to said main frame;

a seat mounted to said seat plate;

a back bracket pivotable with respect to said main frame about a forward pivot;

a medial pivot pivotably connecting said seat plate to said back bracket, said medial pivot medially positioned between said rearward pivot and said forward pivot such that pivoting said back bracket about said forward pivot in one direction draws said medial pivot downwardly so as to tilt said seat plate forwardly; and a chair back mounted to said back bracket.

* * * * *